United States Patent [19]

Nakashima et al.

[11] Patent Number: 4,992,114

[45] Date of Patent: Feb. 12, 1991

[54] PROCESS FOR PRODUCING GRAIN-ORIENTED THIN ELECTRICAL STEEL SHEET HAVING HIGH MAGNETIC FLUX DENSITY BY ONE-STAGE COLD-ROLLING METHOD

[75] Inventors: Shozaburo Nakashima; Katsuro Kuroki; Koji Yamasaki, all of Kitakyushu, Japan

[73] Assignee: Nippon Steel Corporation, Tokyo, Japan

[21] Appl. No.: 324,602

[22] Filed: Mar. 16, 1989

[30] Foreign Application Priority Data

Mar. 18, 1988 [JP] Japan ..... 63-63651
Feb. 3, 1989 [JP] Japan ..... 1-23955

[51] Int. Cl.[5] ..... H01F 1/04
[52] U.S. Cl. ..... 148/111; 148/113
[58] Field of Search ..... 148/113, 111, 112

[56] References Cited

FOREIGN PATENT DOCUMENTS 0036726 9/1981 European Pat. Off. .
0047129 3/1982 European Pat. Off. .
0184891 6/1986 European Pat. Off. .
0219611 4/1987 European Pat. Off. .
58-217630 12/1983 Japan .

OTHER PUBLICATIONS

Patent Abstracts of Japan, vol. 8, No. 67 (C-216) [1504], Mar. 29, 1984.
European Search Report, Application No. EP 89 10 4829.

*Primary Examiner*—John P. Sheehan
*Attorney, Agent, or Firm*—Kenyon & Kenyon

[57] ABSTRACT

The present invention provides a grain-oriented electrical steel sheet having a thickness of up to 0.17 mm and excellent product magnetic characteristics. The present invention is characterized in that a silicon containing acid-soluble Al, N and Sn is used as the starting material, the N and acid-soluble Al contents in the slab are adjusted to 0.0050 to 0.0100% and {(27/14)×N (%)+0.0035} to {(27/14)×N (%)+0.0100}%, respectively, the thickness of the hot-rolled sheet is adjusted so that the thickness reduction ratio at the one-stage cold-rolling is 85 to 92%, and the Nas AlN content in the hot-rolled steel sheet is controlled to 0.0005 to 0.0020%.

2 Claims, 8 Drawing Sheets

| MARK | o | Δ | x |
|---|---|---|---|
| FINE GRAINS | NOT PRESENT | PRESENT | PRESENT |
| FINE GRAIN-FORMED AREA RATIO (%) | 0 | BELOW 10 | ABOVE 10 |
| STATE OF SECONDARY RECRYSTALLIZATION | COMPLETE | POOR | BAD |

| MARK | o | Δ | x |
|---|---|---|---|
| FINE GRAINS | NOT PRESENT | PRESENT | PRESENT |
| FINE GRAIN-FORMED AREA RATIO (%) | 0 | BELOW 10 | ABOVE 10 |
| STATE OF SECONDARY RECRYSTALLIZATION | COMPLETE | POOR | BAD |

| MARK | o | Δ | x |
|---|---|---|---|
| B8 (T) | ABOVE 1.92 | 1.89 ~ 1.91 | BELOW 1.88 |

| MARK | ○ | △ | × |
|---|---|---|---|
| W15/50 (W/kg) | BELOW 0.55 | 0.56~0.60 | ABOVE 0.61 |

PROCESS FOR PRODUCING GRAIN-ORIENTED THIN ELECTRICAL STEEL SHEET HAVING HIGH MAGNETIC FLUX DENSITY BY ONE-STAGE COLD-ROLLING METHOD

BACKGROUND OF THE INVENTION (1) Field of the Invention

The present invention relates to a process for producing a grain-oriented thin electrical steel sheet having a high magnetic flux density and excellent product magnetic characteristics, by a one-stage cold-rolling method. More particularly, the present invention relates to a process for producing a thin steel sheet having a thickness of up to 0.17 mm.

(2) Description of the Prior Art

A grain-oriented electrical steel sheet is used mainly as a soft material for a magnetic core of a transformer or other electric appliances, and must have excellent magnetic characteristics such as exciting and core loss characteristics.

To obtain an electrical steel sheet having such excellent characteristics, the <100> axis, i.e., the easy magnetization axis, must have a good agreement with the rolling direction. Note, the sheet thickness, crystal grain size, inherent resistance, and surface coating have a great influence on the magnetic characteristics.

The directionality of an electrical steel sheet is greatly improved by a one-stage cold-rolling process conducted under a high pressure and in the presence of an inhibitor such as AlN or MnS; currently this process can produce a steel sheet having a magnetic flux density corresponding to about 96% of the theoretical value thereof.

To cope with recent increases in energy costs, transformer manufacturers are attaching much importance to the use of a small-core-loss magnetic material as a material for an energy-saving transformer. Accordingly, an amorphous alloy or a high-Si alloy such as a 6.5%-Si alloy has been developed as the small-core-loss magnetic material, but this alloy is unsatisfactory as a material for a transformer from the viewpoint of cost and processability.

The core loss of an electromagnetic steel sheet is greatly influenced by not only the Si content but also the sheet thickness, and it is known that if the sheet thickness is reduced by chemical polishing or the like, the core loss is reduced.

In Japanese Unexamined Patent Publication No. 58-217630, the present invention proposed a process in which a silicon steel slab containing acid-soluble Al, N, and Sn is used as the starting material and a unidirectionally grain-oriented thin electrical steel sheet having a high magnetic flux density is produced by the high-pressure one-stage cold-rolling method, including the annealing of a hot-rolled steel sheet. This process enabled a grain-oriented thin electrical steel sheet having an excellent core loss and a high magnetic flux density, especially a thin steel sheet having a thickness reduced to 0.225 mm, to be manufactured at a low cost and on an industrial scale, and thus contributed to the eagerly desired saving of energy through a reduction of the core loss in transformers manufactured by using this steel sheet.

Nevertheless, current demands for saving energy have increased, and it has become necessary to further enhance the performance of a grain-oriented electrical steel sheet as a material for a transformer. Namely, it has become necessary to establish a process capable of producing a grain-oriented thin electrical steel sheet having a high magnetic flux density and a thickness of up to 0.175 mm, and having a much smaller core loss than that of the steel sheet having a thickness of 0.225 mm.

Note, according to the process disclosed in Japanese Unexamined Patent Publication No. 58-217630, a steel sheet having a thickness of 0.175 mm or 0.150 mm can be produced, but as shown in Tables 8 and 11 of this patent publication, in the case of a steel sheet having a thickness of up to 0.175 mm, the secondary recrystallization is not satisfactory, and when the process is carried out on an industrial scale, the yield is low and the level of the magnetic characteristics and the stability is not sufficiently high.

SUMMARY OF THE INVENTION

Therefore, a primary object of the present invention is to provide a process by which the problems of the conventional techniques are solved and grain-oriented electrical steel sheet having a thickness of up to 0.17 mm and excellent product magnetic characteristics is produced.

Another object of the present invention to provide a process in which a thin steel sheet as mentioned above is produced by the high-pressure one-stage cold-rolling method, including the annealing of a hot-rolled steel sheet.

According to the present invention, these objects can be obtained by stably producing a grain-oriented thin electrical steel sheet having a high magnetic flux density, which has a complete secondary recrystallization and excellent product magnetic characteristics, by using a silicon steel slab containing acid-soluble Al, N and Sn as the starting material, adjusting the contents of N and acid-soluble Al in the slab to 0.0050 to 0.0100% and $\{(27/14)\times N\ (\%)+0.0035\}$ to $\{(27/14)\times N\ (\%)+0.0100\}\%$, respectively, adjusting the thickness of the hot-rolled steel sheet so that the thickness reduction at the cold-rolling step is 85 to 92%, and performing the hot-rolling so that the N as AlN content in the hot-rolled steel sheet is controlled to 0.0005 to 0.0020%.

DESCRIPTION OF THE PREFERRED EMBODIMENTS

Figure 1:
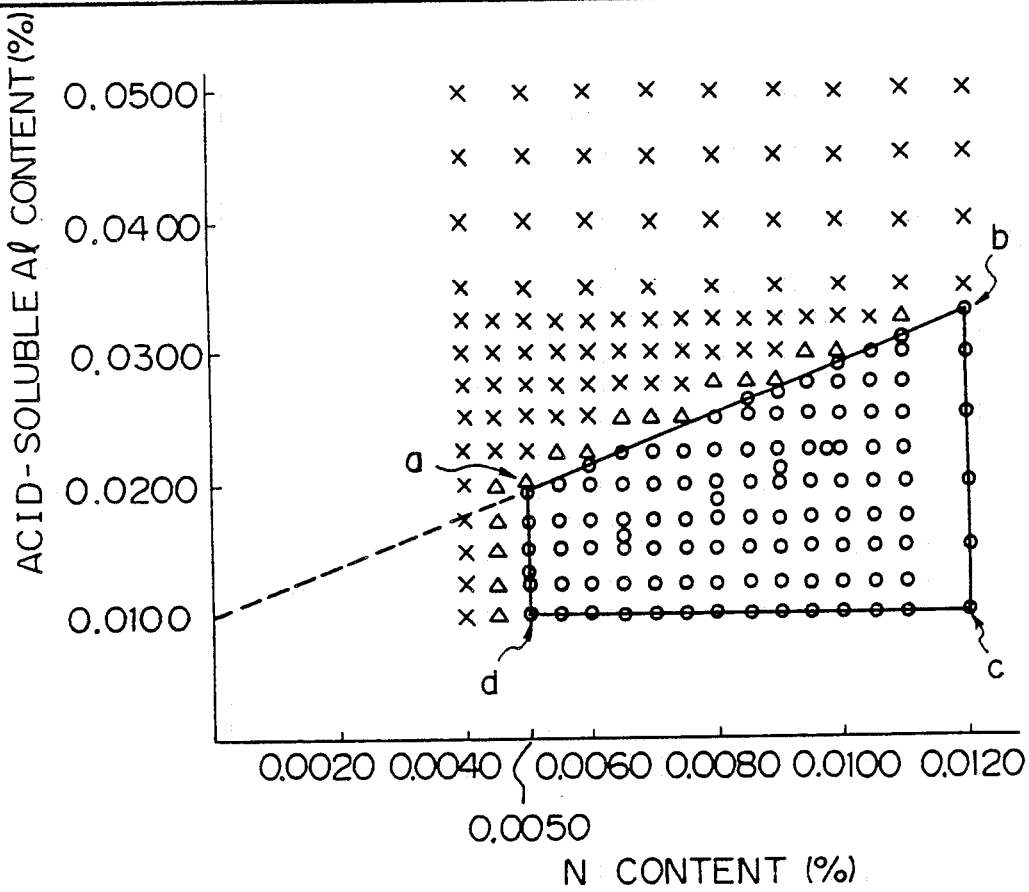
FIG. 1 shows the relationships among the N content (abscissa) and acid-soluble Al content (ordinate) of the slab and the state of the secondary recrystallization (indicated by marks "O" and "X" and the like)

The present invention will now be described with reference to the results of experiments made by the inventors when creating the present invention.

Experiment I

Slabs comprising 0.080% C, 3.25% Si, 0.075% Mn, 0.025% S, 0.13% Sn, 0.0040 to 0.0120% N, and 0.0100 to 0.0500% acid soluble Al, with the balance substantially Fe, were heated at 1370° C. for 60 minutes, were withdrawn from the heating furnace, and were hot-rolled to a thickness of 1.4 mm. The temperature at the termination of the hot-rolled was 1040° to 1050° C. The hot-rolled sheets were then cooled to 550° at a rate of about 70° C./sec, and subsequently allowed to cool in air. The N as AlN content in the hot-rolled sheets was 0.0010 to 0.0012%. The hot-rolled sheets were then annealed at 1100° C. for 30 seconds, and cooled to normal temperature at a rate of 35° C./sec. The annealed sheets were pickled and cold-rolled to a thickness of 0.15 mm, and then decarburization annealed at 850° C. for 150 seconds in an atmosphere composed of 75% $H_2$ and 25% $N_2$ and having a dew point of 65° C. Then, an annealing separating agent composed mainly of magnesia powder was coated on the sheets, and the sheets were heated to 1200° C. at a temperature-elevating rate of 25° C./hr in an atmosphere composed of 85% $H_2$ and 15% $N_2$, soaked at 1200° C. in an $H_2$ atmosphere for 20 hours, and then cooled. The annealing separating agent was then removed and tension coating was carried out to obtain the required products. The magnetic flux density B8 and core loss W15/50 of each product were measured, and then the coating and the glass film were removed and the macro-structure was observed.

Figure 2:
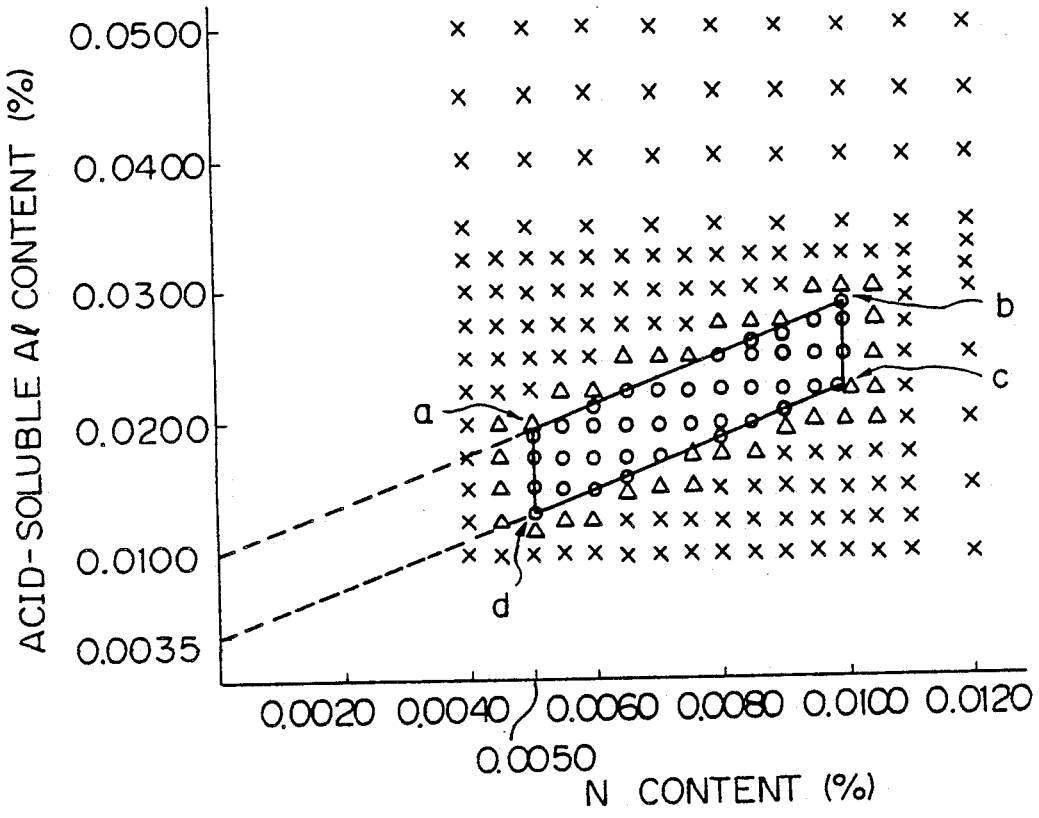
FIG. 2 shows the relationships among the N content (abscissa) and acid-soluble Al content (ordinate) of the slab and the magnetic flux density B8 (indicated by marked "O" and "X" and the like) of the product.
Figure 3:
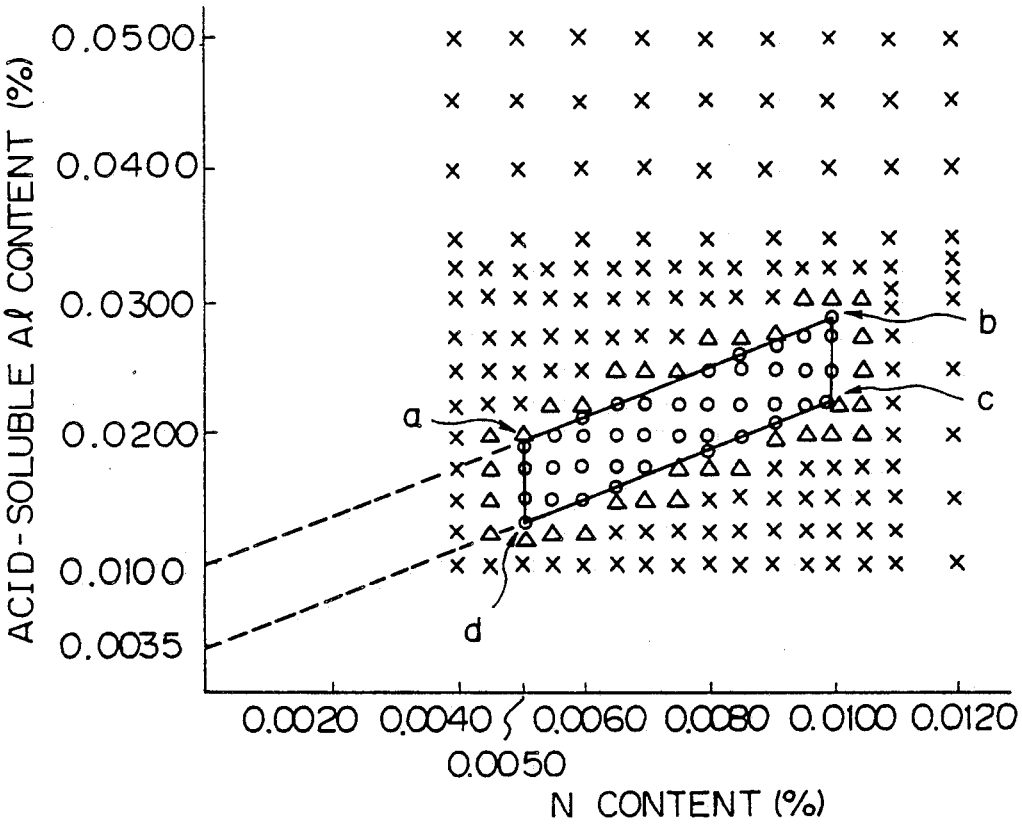
FIG. 3 shows the relationships among the N content (abscissa) and acid-soluble Al content (ordinate) of the slab and the core loss W15/50 (indicated by marks "O" and "X" and the like) of the product.

The relationships between the N and acid-soluble Al contents of the slab and the state of the secondary recrystallization, B8 and W15/50, are shown in FIGS. 1, 2, and 3, respectively.

In FIG. 1, the N content is plotted on the abscissa and the acid-soluble Al content is plotted on the ordinate. The stage of the secondary recrystallization is indicated by marks "O", "Δ" and "X". The secondary recrystallization was complete in the region surrounded by lines ab, bc, cd, and da in FIG. 1. The line ab is represented by the following formula:

$$\text{line ab: acid-soluble Al (\%)} = (27/14) \times \text{N (\%)} + 0.0100(\%)$$

Namely, it was found that the secondary recrystallization is complete when the N content is 0.0050 to 0.0120% and the acid-soluble Al content is 0.0100 to {(27/14)×N (%)+0.0100}%.

In FIG. 2, the N content is plotted on the abscissa and the acid-soluble Al content is plotted on the ordinate. B8 is indicated marks "O", "Δ" and "X". Good B8 values were obtained in the region surrounded by lines ab, bc, cd, and da in FIG. 2.

The lines ab and cd are represented by the following formulae:

$$\text{line ab: acid-soluble Al (\%)} = (27/14) \times \text{N (\%)} + 0.0100(\%)$$

$$\text{line cd: acid-soluble Al (\%)} = (27/14) \times \text{N (\%)} + 0.0035(\%)$$

Namely, it was found that a good core loss B8 is obtained when the N content is 0.0050 to 0.0100% and the acid-soluble Al content is {(27/14)×N (%)+0.0035} to {(27/14)×N (%)+0.0100}.

In FIG. 3, the N content is plotted on the abscissa and the acid-soluble Al content is plotted on the ordinate, and W15/50 is indicated by marks "O", "Δ" and "X". Good W15/50 values were obtained in the region surrounded by lines ab, bc, cd, and da in FIG. 3.

The lines ab and cd are represented by the following formulae:

$$\text{line ab: acid-soluble Al (\%)} = (27/14) \times \text{N (\%)} + 0.0100\ (\%)$$

$$\text{line cd: acid-soluble Al (\%)} = (27/14) \times \text{N (\%)} + 0.0035\ (\%)$$

Namely, it was found that a good value of W15/50 is obtained when the N content is 0.0050 to 0.0100% and the acid-soluble content is {(27/14)×N (%)+0.0035} to {(27/14)×N (%)+0.0100}%.

From the results shown in FIGS. 1, 2 and 3, it was found that the secondary recrystallization is complete and a product having good B8 and W15/50 value is obtained when the N content is 0.0050 to 0.0100% and the acid-soluble content is {(27/14)×N (%)+0.0035} to {(27/14)×N (%)+0.0100}%.

In the region where the W15/50 value is bad, although the secondary recrystallization is complete, the B8 value is lower. Namely, in the region where the Al content is low and the N content is high, the secondary recrystallization is stable but the directionality is degraded, and it becomes difficult to obtain a good core loss value.

Note, (27/14)×N (%) corresponds to the Al content necessary for converting all of the N contained in the steel to AlN. In the process of the present invention where AlN is utilized as the main inhibitor, it is obvious that the domination by the secondary recrystallization of the magnetic flux density and core loss of the product is greatly influenced by the Al content based on (27/14)×N (%).

Experiment II

Slabs comprising 0.082% C, 3.25% Si, 0.070% Mn, 0.025% S, 0.14% Sn, 0.0085 N, and 0.0240% acid-soluble Al with the balance substantially Fe, were heated at 1370° C. for 60 minutes, withdrawn from the heating furnace, and hot-rolled to a thickness of from 0.75 to 3.0 mm. By changing the cooling conditions before, during and after the rolling, the amount of N as AlN in the hot-rolled sheets was changed from 0.0001 to 0.0036%. The value of the AlN content was obtained by an analysis of the entire thickness. The analysis was performed by the bromine-methanol method (all analyses of AlN in the present invention were carried out by the brominemethanol method). These hot-rolled steel sheets were then treated in the same manner as described in Experiment I to obtain the required products.

The magnetic flux density B8 and core loss W15/50 of each product were measured, and then the coating and the glass film were removed and the macro-structure observed. The relationships among the N as AlN content of the hot-rolled steel sheet and the cold-rolling thickness reduction ratio and the state of the secondary recrystallization, B8 and W15/50 are shown in FIGS. 4, 5, and 6, respectively.

Figure 4:
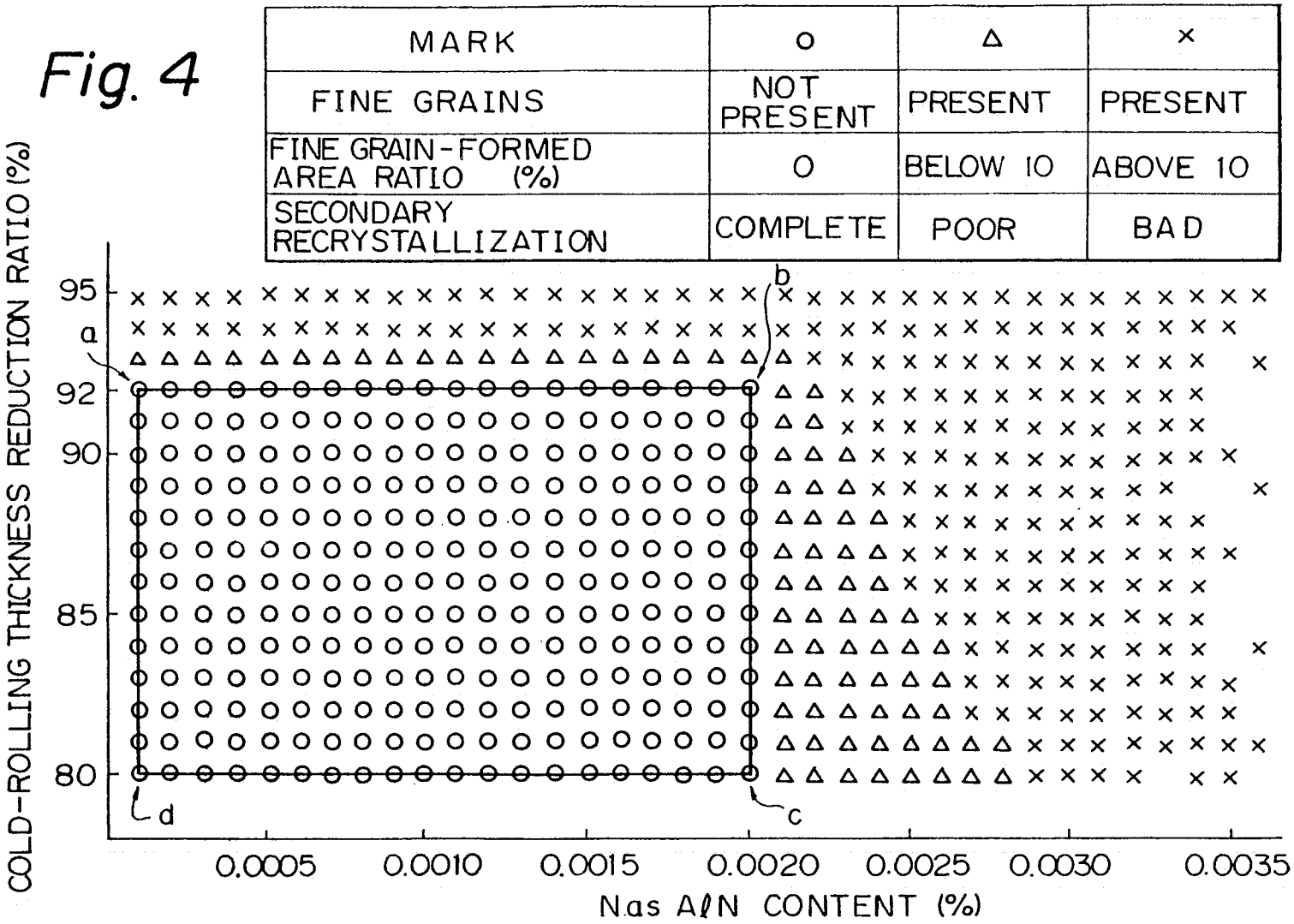
FIG. 4 shows the relationships among the N as AlN content (abscissa) of the hot-rolled steel sheet, the cold-rolling thickness reduction ratio (ordinate) and the state of the secondary recrystallization (indicated by marks "O" and "X" and the like)

In FIG. 4, the Nas AlN content is plotted on the abscissa, the cold-rolling thickness reduction ratio is plotted on the ordinate, and the state of the secondary recrystallization is indicated by marks "O", "Δ" and "X". The secondary recrystallization was complete in the region surrounded by lines ab, bc, cd, and da in FIG. 4. Namely, it was found that the secondary recrystallization is complete when the N as AlN content is 0.0001 to 0.0020% and the cold-rolling thickness reduction ratio is 80 to 92%.

Figure 5:
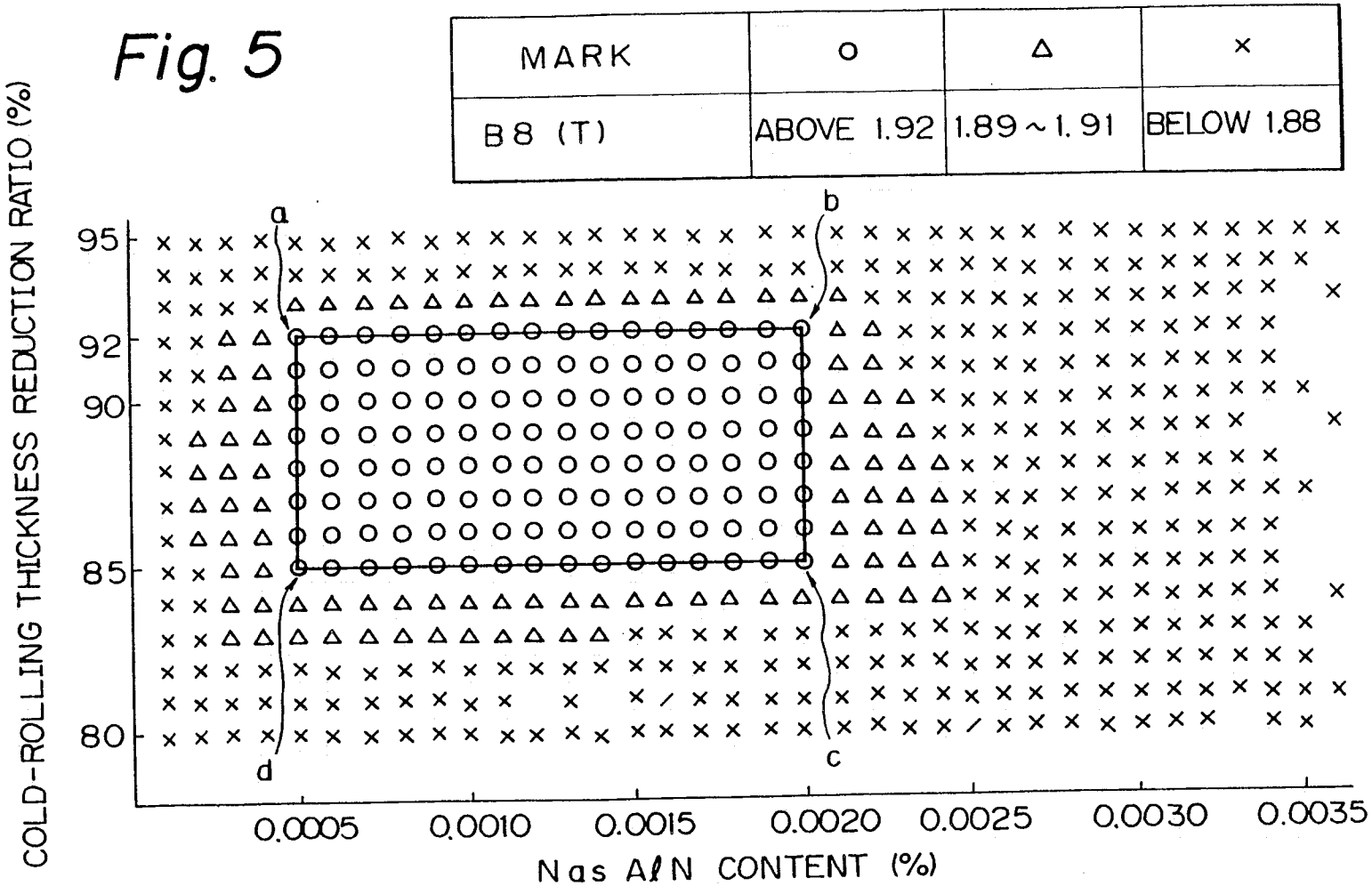
FIG. 5 shows the relationships among the N as AlN content (abscissa) of the hot rolled steel sheet, the cold-rolling thickness reduction ratio (ordinate) and the magnetic flux density B8 (indicated by marks "O" and "X" and the like) or the product.

In FIG. 5, the N as AlN content is plotted on the ordinate, the cold-rolling thickness reduction ratio is plotted on the ordinate, and the value of B8 is indicated by marks "O", "Δ" and "X". A good value of B8 was obtained in the region surrounded by lines ab, bc, cd, and da in FIG. 5. Namely, it was found that a good B8 value is obtained when the N as AlN content is 0.0005 to 0.0020% and the cold-rolling thickness reduction ratio is 85 to 92%.

Figure 6:
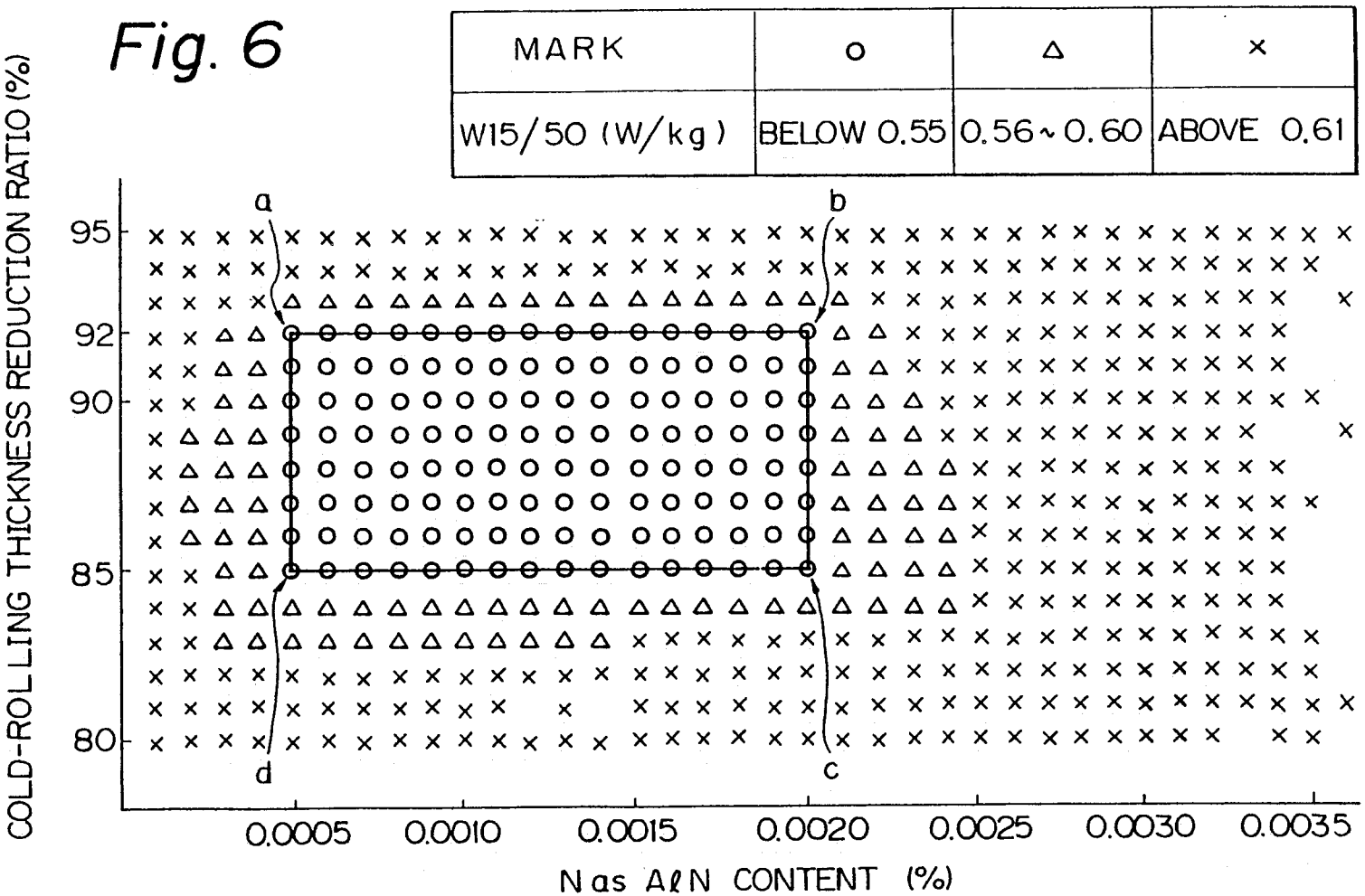
FIG. 6 shows the relationships among the N as AlN content (abscissa) of the hot-rolled steel sheet, the cold-rolling thickness reduction ratio (ordinate) and the core loss W15/50 (indicated by marks "O" and "X" and the like) of the product.

In FIG. 6, the N as AlN content was plotted on the abscissa, the cold-rolling thickness reduction ratio is plotted on the ordinate, and the value of W15/50 is indicated by marks "O", "Δ" and "X". A good W15/50 value was obtained in the region surrounded by lines ab, bc, cd, and da in FIG. 6. Namely, it was found that a good W15/50 value is obtained when the N as Al content is 0.0005 to 0.0020% and the cold-rolling thickness reduction ratio is 85 to 92%.

From the results shown in FIGS. 4, 5, and 6, it was found that the secondary recrystallization is complete and a product having good B8 and W15/50 values is obtained when the N as AlN content is 0.0005 to 0.0020 and the cold-rolling thickness reduction ratio in 85 to 92%.

In the region where the W15/50 value is bad, although the secondary recrystallization is complete, the B8 value is lower.

From the results obtained in Experiments I and II, it was found that in the process producing a grain-oriented thin electrical steel sheet by using a silicon steel slab containing acid-soluble Al, N, and Si as the starting material, and reducing the thickness to 0.12 to 0.17 mm by the high-pressure one-stage cold-rolling method including an annealing of a hot-rolled steel sheet, a grain-oriented thin electrical steel sheet having a high magnetic reflux density, a complete secondary recrystallization, and excellent product magnetic characteristics, can be stably manufactured if the content of N and acid-soluble Al in the slab are adjusted to 0.0050 to 0.0100% and $\{(27/14) \times N\ (\%)+0.0035\}$ to $\{(27/14)\times N\ (\%)+0.0100\}$%, respectively, the thickness of the hot-rolled steel sheet is adjusted so that the thickness reduction ratio at the cold-rolling step is 85 to 92%, and the hot-rolling is carried out so that the N as Al content in the hot-rolled steel sheet is controlled to 0.0005 to 0.0020%.

The reason why a product having a complete secondary recrystallization and excellent magnetic characteristics is obtained by carrying out the hot-rolling so that the N as AlN content in the hot-rolled steel sheet is controlled to 0.0005 to 0.0020% has not been completely elucidated, but it is considered that where a grain-oriented thin electrical steel sheet having a thickness smaller than 0.17 mm and a high magnetic flux density is produced by the one-stage cold-rolling method, the texture of the hot-rolled steel sheet after annealing and the state of the precipitate have a stronger influence on the characteristics of the product than where a thick product is prepared or the multi-stage cold-rolling method is adopted. Furthermore, it is considered that the N as AlN content in the hot-rolled steel sheet has a slight influence on the change of the texture in the steel sheet by annealing of the hot-rolled steel sheet and the behavior of the precipitate, and that when the N as AlN content in the hot-rolled steel sheet is 0.0005 to 0.0020%, the properties of the steel sheet obtained by annealing of the hot-rolled steel sheet which are most advantageous for the characteristics of the product, will be obtained.

As the means for controlling the N as AlN content in the hot-rolled steel sheet to 0.0005 to 0.0020%, there can be mentioned a method of controlling the slab-heating conditions, a method of controlling the crude rolling conditions, a method of controlling the finish rolling conditions, and a method of controlling the cooling conditions after the finish rolling, and any of these methods can be adopted.

At least one of Cu and Sb was added to the materials used in Experiments I and II, the test was carried out in the manner as described in Experiments I and II, and similar results were obtained.

Experiment III

Figure 7:
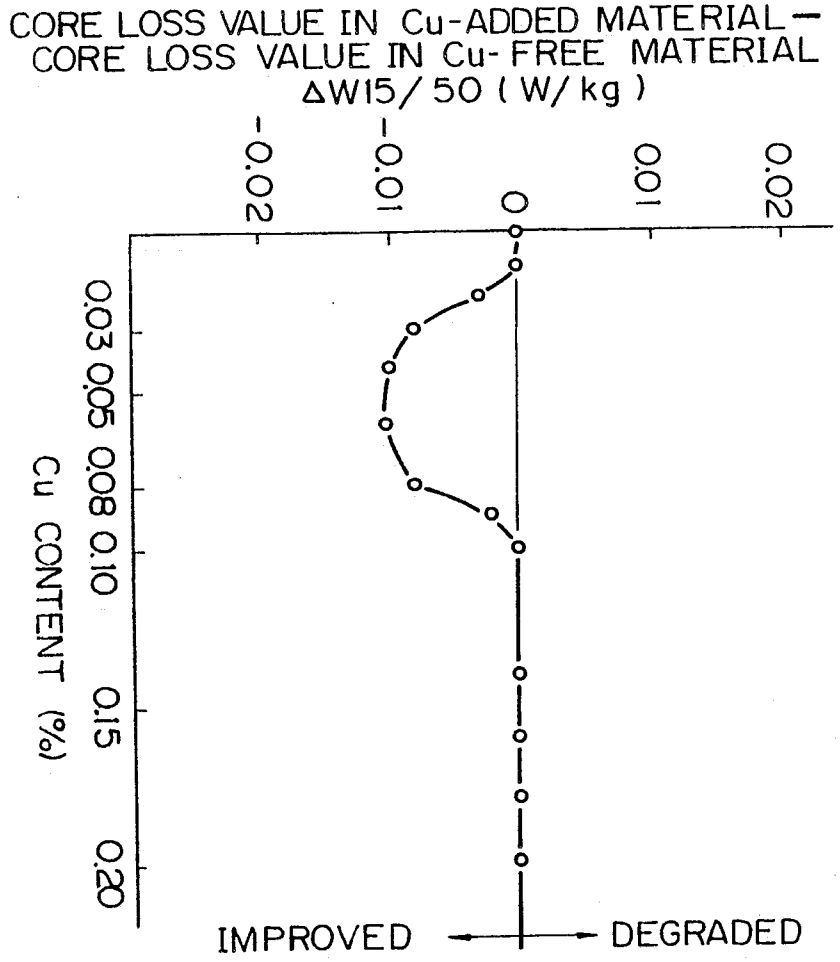
FIG. 7 shows the relationships between the Cu content (abscissa) of the slab and the change of the core loss W15/50 (ordinate) of the product by an addition of Cu; and, FIG. 8 shows the relationships between the Sb content (abscissa) of the slab and the change of the core loss W15/50 (ordinate) of the product by addition of Sb.

Slabs comprising 0.083% C, 3.25% Si, 0.076% Mn, 0.025% S, 0.14% Sn, 0.0085% N, 0.0235% acid-soluble Al and 0 or 0.01 to 0.20% Cu, with the balance substantially Fe, were subjected to the same hot-rolling and subsequent treatment as described in Experiment I, to obtain products. The relationships between the Cu content and the core loss is shown in FIG. 7. As apparent from FIG. 7, the core loss characteristics were improved if the Cu content was from 0.03 to 0.08%.

Figure 8:
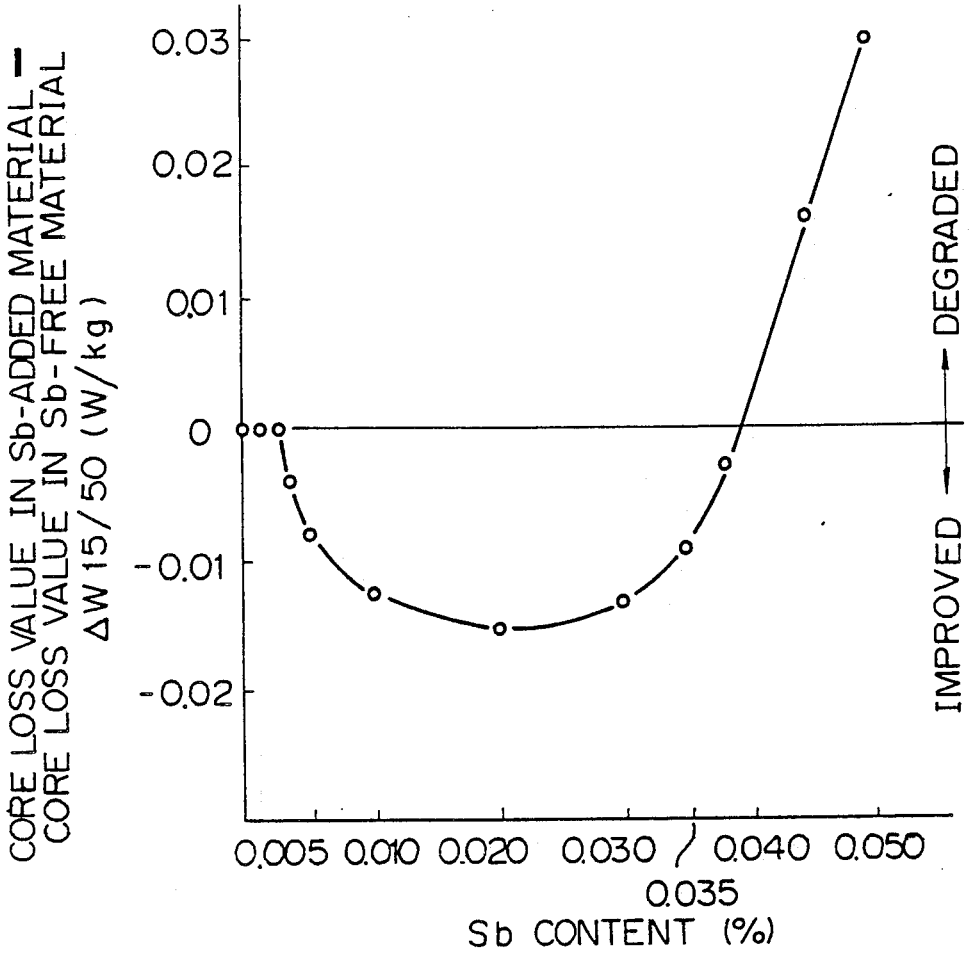

Slabs comprising 0.08% C, 3.23% Si, 0.075% Mn, 0.025% S, 0.13% Sn, 0.0085% N, 0.0230% acid-soluble Al and 0 or 0.001 to 0.050% Sb, with the balance substantially Fe, were subjected to the same hot-rolling and subsequent treatments as described in Experiment I, to obtain products. The relationships between the Sb content and the core loss is shown in FIG. 8. As apparent from FIG. 8, the core loss characteristics were improved when the Sb content was from 0.005 to 0.035%.

The reasons for the limitations of the composition of the slab and the treatment conditions in the production process of the present invention will now be described.

The C content is preferably 0.060 to 0.120%, as when the C content is lower than 0.060% or higher than 0.120%, the secondary recrystallization becomes unstable.

The Si content is preferably 2.9 to 4.5%, as when the Si content is lower than 2.9%, a good (small) core loss is not obtained, and when the Si content is higher than 4.5%, the processability (adaptability to cold-rolling) is unsatisfactory.

The Mn content is preferably 0.050 to 0.090%, as when the Mn content is lower than 0.050% or higher than 0.090%, the secondary recrystallization becomes unstable.

The content of at least one of S and Se is preferably 0.020 to 0.060%, as when this content is lower than 0.020%, the secondary recrystallization becomes unstable, and when this content is higher than 0.060%, the core loss characteristics are unsatisfactory.

The Sn content is preferably 0.05 to 0.25%, as when the Sn content is lower then 0.05%, the secondary recrystallization becomes unstable, and when the Sn content is higher than 0.25%, the processability is unsatisfactory.

To properly solid-dissolve a sulfide and a nitride at the slab-heating step, a high-temperature heating must be carried out. Preferably, this heating is carried out at a temperature higher than 1300° C.

Preferably, the hot-rolled steel sheet is annealed at 1030° to 1200° C. within 10 minutes, as when the annealing temperature is lower than 1030° C., a product having good magnetic characteristics cannot be obtained, and when the annealing temperature is higher than 1200° C., the secondary recrystallization becomes unstable. If the annealing is conducted for more than 10 minutes, an improvement of the produce characteristics cannot be expected and the process becomes economically disadvantageous. Preferably after the annealing, the sheet is cooled to 200° C. at a rate of 10° to 60° C./sec, as when the temperature-lowering rate is lower than 10° C./sec, a product having good magnetic characteristics cannot be obtained, and when the temperature-lowering rate is higher than 60° C./sec, the secondary recrystallization becomes unstable. The one-stage cold-rolling method is preferable to the two-stage cold-rolling method because the manufacturing cost is much lower. Preferably, the sheet thickness after the cold-rolling is 0.12 to 0.17 mm, as when the sheet thickness is smaller than 0.12 mm, the secondary recrystallization becomes unstable, and when the sheet thickness is larger than 0.17 mm, a desired core loss value cannot be obtained. Note, if the steel sheet is maintained at 200° to 300° C. for 1 to 5 minutes during the cold-rolling, a greater improvement of the magnetic characteristics of the product is obtained. Preferably, an atmosphere containing nitrogen is used during the high-temperature finish annealing, at least until the temperature is elevated to 1000° C., as when the atmosphere does not contain nitrogen, the secondary recrystallization becomes unstable.

EXAMPLE

Slabs comprising 0.080% C, 3.25% Si, 0.076% Mn, 0, 0.015 or 0.025% S, 0, 0.015 or 0.025% Se, 0.13% Sn, 0.0045, 0.0085 or 0.0110% N, 0.0150, 0.0170, 0.0230, 0.0260 or 0.0300% acid soluble Al, 0 or 0.07% Cu and 0 or 0.020% Sb, with the balance substantially Fe, were heated at 1360° C. for 60 minutes, were withdrawn from the heating furnace, and hot-rolled to a thickness of 0.92, 1.00, 1.31 or 2.43 mm. Note, the cooling conditions before, during and after the rolling were changed, and the N as AlN content in the hot-rolled sheets was 0.0002 to 0.0035%.

The hot-rolled steel sheets were annealed at 1120° for 60 seconds and then cooled to normal temperature at a rate of about 35° C./sec. The annealed steel sheets were pickled and cold-rolled to a thickness of 0.12 or 0.17 mm, and the decarburized at 850° C. for 150 seconds in an atmosphere comprising 75% $H_2$ and 25% $N_2$ and having a dew point of 65° C. An annealing separating agent composed mainly of magnesia powder was coated thereon, and the sheets were heated to 1200° C. at a rate of 25° C./hour in an atmosphere comprising 85% $H_2$ and 15% $N_2$, soaked at 1200° C. for 200 hours in an $H_2$ atmosphere, and then cooled. The annealing separating agent was removed and tension coating thereon was applied to obtain the required products. The magnetic flux density B8 and core loss W15/50 of each product were measured, and then the coating and the glass film were removed and the macro-texture was observed. The results are shown in Table 1. As apparent from Table 1, only when the N and acid-soluble Al contents of the slab, the N as AlN content of the hot-rolled steel and the cold-rolling thickness reduction ratio are within the ranges specified in the present invention, can products having a complete secondary recrystallization and excellent B8 and W15/50 values be obtained. Also, products having further improved characteristics were obtained when the Cu ad Sb contents were within the ranges specified in the present invention.

As apparent from the foregoing description, according to the present invention having the above-mentioned construction, a grain-oriented thin electrical steel sheet having a high magnetic flux density, a complete secondary recrystallization, and excellent product magnetic characteristics, can be stably produced by using a silicon steel slab containing acid-soluble Al, N and Sn as the starting material and cold-rolling the steel sheet to a thickness of 0.12 to 0.17 mm by the high pressure one-stage cold-rolling method, including an annealing of the hot-rolled steel sheet.

TABLE 1-1

| | Components of Silicon Steel Slab | | | | | | | |
|---|---|---|---|---|---|---|---|---|
| Run No. | S $\times 10^{-3}$ % | Se $\times 10^{-3}$ % | N $\times 10^{-4}$ % | Acid-soluble Al $\times 10^{-4}$ % | $\frac{27}{14} \times$ N (%) + 0.0035 (%) $\times 10^{-4}$ % | $\frac{27}{14} \times$ N (%) + 0.0100 (%) $\times 10^{-4}$ % | Cu $\times 10^{-2}$ % | Sb $\times 10^{-3}$ % |
| 1 | 25 | not added | 85 | 230 | 199 | 264 | not added | not added |
| 2 | 25 | " | × 45 | 150 | 122 | 187 | " | " |
| 3 | 25 | " | × 110 | 260 | 247 | 312 | " | " |
| 4 | 25 | " | 85 | × 170 | 199 | 264 | " | " |
| 5 | 25 | " | 85 | × 300 | 199 | 264 | " | " |
| 6 | 25 | " | 85 | 230 | 199 | 264 | " | " |
| 7 | 25 | " | 85 | 230 | 199 | 264 | " | " |
| 8 | 25 | " | 85 | 230 | 199 | 264 | " | " |
| 9 | 25 | " | 85 | 230 | 199 | 264 | " | " |
| 10 | not added | 25 | 85 | 230 | 199 | 264 | " | " |
| 11 | 15 | 15 | 85 | 230 | 199 | 264 | not added | not added |
| 12 | 25 | not added | 85 | 230 | 199 | 264 | 7 | " |

TABLE 1-1-continued

| Run No. | Components of Silicon Steel Slab: S $\times 10^{-3}$ % | Se $\times 10^{-3}$ % | N $\times 10^{-4}$ % | Acid-soluble Al $\times 10^{-4}$ % | $\frac{27}{14} \times$ N (%) + 0.0035 (%) $\times 10^{-4}$ % | $\frac{27}{14} \times$ N (%) + 0.0100 (%) $\times 10^{-4}$ % | Cu $\times 10^{-2}$ % | Sb $\times 10^{-3}$ % |
|---|---|---|---|---|---|---|---|---|
| 13 | 25 | " | 85 | 230 | 199 | 264 | not added | 20 |
| 14 | 25 | " | 85 | 230 | 199 | 264 | 7 | 20 |
| 15 | 15 | 15 | 85 | 230 | 199 | 264 | 7 | not added |
| 16 | 15 | 15 | 85 | 230 | 199 | 264 | not added | 20 |
| 17 | 15 | 15 | 85 | 230 | 199 | 264 | 7 | 20 |
| 18 | not added | 25 | 85 | 230 | 199 | 264 | 7 | 20 |
| 19 | 15 | 15 | 85 | 230 | 199 | 264 | 7 | not added |

Note
x: outside the range specified in the present invention

TABLE 1-2

| Run No. | N as AlN Content of Hot-Rolled Sheet $\times 10^{-4}$% | Thickness of Hot-Rolled Sheet mm | Thickness of Cold-Rolled Sheet mm | Cold-Rolling Thickness Reduction Ratio % | State of Secondary Recrystallization: Ratio of fine grain-formed area % | Judge-ment – | Product Magnetic Characteristics: B8 T | W15/50 W/kg | Remarks |
|---|---|---|---|---|---|---|---|---|---|
| 1 | 10 | 1.31 | 0.17 | 87.0 | 0 | complete | 1.93 | 0.55 | Present invention |
| 2 | 11 | 1.31 | 0.17 | 87.0 | 8 | poor | 1.89 | 0.62 | Comparison |
| 3 | 9 | 1.31 | 0.17 | 87.0 | 0 | complete | 1.87 | 0.65 | " |
| 4 | 10 | 1.31 | 0.17 | 87.0 | 0 | " | 1.89 | 0.62 | " |
| 5 | 12 | 1.31 | 0.17 | 87.0 | 30 | bad | 1.80 | 0.75 | " |
| 6 | × 35 | 1.31 | 0.17 | 87.0 | 40 | bad | 1.75 | 0.84 | " |
| 7 | × 2 | 1.31 | 0.17 | 87.0 | 0 | complete | 1.88 | 0.64 | " |
| 8 | 11 | × 1.00 | 0.17 | × 83.0 | 0 | " | 1.89 | 0.62 | " |
| 9 | 10 | × 2.43 | 0.17 | × 93.0 | 8 | bad | 1.89 | 0.62 | " |
| 10 | 12 | 1.31 | 0.17 | 87.0 | 0 | complete | 1.94 | 0.54 | Present invention |
| 11 | 10 | 1.31 | 0.17 | 87.0 | 0 | complete | 1.95 | 0.53 | " |
| 12 | 9 | 1.31 | 0.17 | 87.0 | 0 | " | 1.93 | 0.54 | " |
| 13 | 14 | 1.31 | 0.17 | 87.0 | 0 | " | 1.94 | 0.53 | " |
| 14 | 12 | 1.31 | 0.17 | 87.0 | 0 | " | 1.94 | 0.52 | " |
| 15 | 11 | 1.31 | 0.17 | 87.0 | 0 | " | 1.95 | 0.52 | " |
| 16 | 13 | 1.31 | 0.17 | 87.0 | 0 | " | 1.95 | 0.52 | " |
| 17 | 14 | 1.31 | 0.17 | 87.0 | 0 | " | 1.96 | 0.51 | " |
| 18 | 8 | 1.31 | 0.17 | 87.0 | 0 | " | 1.94 | 0.53 | " |
| 19 | 8 | 0.92 | 0.12 | 87.0 | 0 | " | 1.93 | 0.48 | " |

We claim:

1. A process for producing a grain-oriented thin electrical steel sheet having a high magnetic flux density and excellent product magnetic characteristics by a one-stage cold-rolling method, which comprises heating at a high temperature a slab comprising 0.060 to 0.120% by weight of C, 2.9 to 4.5% by weight of Si, 0.050 to 0.090% by weight of Mn, 0.020 to 0.060% by weight of at least one of S and Se and 0.05 to 0.25% by weight of Sn, with the balance comprising acid-soluble Al, N, Fe and unavoidable impurities, hot-rolling the slab to provide a hot-rolled steel sheet, annealing the hot-rolled steel sheet at a temperature of 1030° to 1200° C. for less than 10 minutes, cooling the annealed steel sheet to 200° C. at a cooling rate of 10° to 60° C./sec, cold-rolling the steel sheet to a thickness of 0.12 to 0.17 mm, subjecting the cold-rolled steel sheet to decarburization annealing in a hydrogen-containing wet atmosphere, coating an annealing separating agent composed mainly of magnesia powder on the steel sheet, subjecting the steel sheet to high-temperature finish annealing, said finish annealing comprising elevating temperature until the temperature is elevated to at least 1000° C. and providing an atmosphere containing nitrogen during said elevating of the temperature and then holding the temperature of said at least 1000° C. and providing a hydrogen atmosphere during said holding of the temperature, applying a tension coating to said steel sheet after said finish annealing, wherein the N and acid-soluble Al contents in the slab are 0.0050 to 0.010% and [(27/14)×N (%)+0.0035] to [(27/14)×N (%)+0.0100]%, respectively, the thickness of the hot-rolled steel sheet is controlled so that the cold-rolling thickness reduction ratio is 85 to 92%, and the N as AlN content in the hot-rolled steel sheet is controlled to 0.0005 to 0.0020%.

2. A process according to claim 1, wherein 0.03 to 0.08% by weight of Cu and/or 0.005 to 0.035% by weight of Sb is further incorporated into the starting slab.

* * * * *